US008965245B2

(12) United States Patent
Atwood et al.

(10) Patent No.: US 8,965,245 B2
(45) Date of Patent: Feb. 24, 2015

(54) SINGLE FUNCTION BTR WITH ZERO MEDIA WRAP ANGLE

(75) Inventors: Mark A. Atwood, Rush, NY (US); Roger Gaylord Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 413 days.

(21) Appl. No.: 13/309,116

(22) Filed: Dec. 1, 2011

(65) Prior Publication Data

US 2013/0142544 A1 Jun. 6, 2013

(51) Int. Cl.
*G03G 15/00* (2006.01)

(52) U.S. Cl.
USPC ..... 399/121; 399/313

(58) Field of Classification Search
USPC ..... 399/121, 302, 308, 313–315, 317
See application file for complete search history.

(56) References Cited

U.S. PATENT DOCUMENTS

| | | | | |
|---|---|---|---|---|
| 4,611,901 | A | 9/1986 | Kohyama et al. | |
| 4,660,059 | A | 4/1987 | O'Brien | |
| 4,833,503 | A | 5/1989 | Snelling | |
| 5,970,304 | A | 10/1999 | Stemmle | |
| 7,158,746 | B2 | 1/2007 | Swift | |
| 7,242,894 | B2 | 7/2007 | Kuo et al. | |
| 2011/0013950 | A1* | 1/2011 | Furuya et al. | 399/302 |
| 2012/0301186 | A1* | 11/2012 | Yang et al. | 399/121 |

OTHER PUBLICATIONS

U.S. Appl. No. 13/152,555, filed Jun. 3, 2011, Leighton et al.

* cited by examiner

*Primary Examiner* — Walter L Lindsay, Jr.
*Assistant Examiner* — Jessica L Eley
(74) *Attorney, Agent, or Firm* — Fay Sharpe LLP

(57) ABSTRACT

An electrostatographic printing apparatus that includes a charge receptor endless belt; a transfer nip including a BTR roll in contact with the charge receptor at a transfer zone, a continuous media supplied to the transfer zone, and the transfer nip adapted for systematic engagement and disengagement with the continuous media for synchronization of image transfer from the charge receptor to the media. More specifically, in response to recognition of imaging inconsistencies such as belt seams, test patches, or label format pitches, the endless belt disengages from the continuous media at the BTR roll. The BTR roll is appropriately turned on and off and the continuous media reversed in direction commonly known as a 'Pilgrim step', then returned to normal direction to synchronize the transfer of images to the continuous media, wherein there is substantially zero wrap of the continuous media on the BTR roll during the engagement of the continuous media with the charge receptor belt.

21 Claims, 16 Drawing Sheets

SINGLE FUNCTION BTR WITH ZERO MEDIA WRAP ANGLE

CROSS REFERENCE TO RELATED PATENTS AND APPLICATIONS

U.S. patent application Ser. No. 13/152,555, filed Jun. 3, 2011 by Leighton et al. and entitled "SINGLE BTR ROLL AT STRIPPER FOR CONTINUOUS WEB TRANSFER is incorporated herein by reference in its entirety.

BACKGROUND

This disclosed device and method relates generally to a transfer station used in electrostatographic or xerographic printing.

The basic process steps of electrostatographic printing, such as xerography or iconography include creating an image with the toner particles which is transferred to a print medium, which is typically a sheet of paper but which could be any kind of substrate, including an intermediate transfer belt or continuous web. This transfer is typically carried out by the creation of a "transfer zone" of electric fields where the print sheet is in contact with, or otherwise proximate to, the photoreceptor. Devices to create this transfer zone are well known in the prior art.

For example, the use of BTR (Biased Transfer Roll) foam rollers to either pull an image from a PR (Photoreceptor) belt or drum to an intermediate belt or from an intermediate belt to paper are often used. Typically, in such transfer operations, as shown in U.S. Pat. Nos. 7,242,894 and 7,158,746, a biased transfer roll is disposed in contact with a portion of a photoreceptor, thus forming an image transfer nip. An image-receiving sheet passes through the nip between the photoreceptor and transfer roll. At the nip itself, a toner image on the photoreceptor is transferred to the sheet by a combination of physical pressure at the nip, caused at least in part by the transfer roll, and an electrical bias placed on the transfer roll by suitable circuitry.

However, if the paper or substrate being fed is not a cut sheet, but rather a continuous roll of sheet paper or label media, the standard transfer process is inadequate. The conversion of a high speed, high volume Xerographic machine with a cut sheet paper supply to a continuous paper roll feed for label or book production requires an entirely new transfer area, that will not disturb the unfused toner either by lateral or process direction shear forces resulting from velocity mismatches or from air breakdown while the media makes contact to the belt. Various events must be considered such as the skipping of the photoreceptor (PR) belt seam and skipping various other images on the belt such as test patches, in order that the pitch to pitch distance of images transferred to the paper and paper roll feed is held consistent. The new system must also be configured such that air break down does not occur disturbing the image by reducing the nip area, pre-wrapping the PR assist roll, and sufficient attack exit angle.

In web feeding, the image substrate material is typically fed from large rolls of paper in a defined width as previously stated. A difficulty, however, in printing from an endless belt type photoreceptor printing engine onto a continuous web substrate is the fact that belt type photoreceptors typically have a belt seam where the two ends of the belt are fastened to one another to form a continuous loop. Typically, it is either impossible or undesirable to form images overlying this belt seam, resulting in asynchronous or irregularly spaced image production. This, in general, can be a significant problem to the transfer of those images to a substrate. The problem is more severe, in particular, in the synchronization of images with a continuous web substrate.

Heretofore, it has been difficult or impractical to rapidly start and stop paper webs running through a printing system at high speeds because of the danger of web tearing, slippage, or misregistration, and/or the large moment and mass of the paper roll. As disclosed in U.S. Pat. No. 5,970,304, buffer loops and dancer rolls are known for the buffering of web speed variations and also the separation of the web from the nip to adjust the relationship of the photoreceptor belt and web for facilitating the transfer of images from the belt to the web.

It would also be desirable to provide other possible advantages to prior continuous paper feed systems such as better registration error control, and a smaller transfer nip. For example, a BTR transfer zone is typically only 3-5 mm, which makes it easier to insure good image quality and low shear area due to either web velocity mis-match errors or lateral position error moments. Also, it may be desirable to fully strip the web with the image prior to the seam before disengaging the web from the photoreceptor.

Thus, in order to maintain the continuous paper web feed pitch and compensate for occurrences such as the need to avoid the seam on the PR belt, a BTR roll is provided at the transfer zone or station and the paper web separated from the BTR nip. The continuous paper web is driven backwards and then accelerated to position the paper web at exactly the correct location prior to the paper web and PR belt uniting at the BTR roll nip. This is known as a 'Pilgrim step' in the converting industry.

In operation, according to the disclosure, a suitable BTR roll, often a soft foam roll, when engaged with an auxiliary or stripper roll will produce a nip of 3-5 mm wide for generating a transfer field and depositing a positive tacking charge to the backside of the paper. The toner is negative and is drawn to the paper from the photoreceptor belt. The coordination of web tension, auxiliary roll, and BTR roll will provide controllable belt engagement and defined timing of transfer of image without destructive uncontrolled air breakdown to the image. The timing of the auxiliary roll and BTR roll engagement after reversing will allow for synchronization of the turn on of the field in the gap between images without creating toner disturbances.

INCORPORATION BY REFERENCE

U.S. Pat. No. 4,611,901, issued Sep. 16, 1986 to Kohyama et al. and entitled "ELECTROPHOTOGRAPHIC METHOD AND APPARATUS";

U.S. Pat. No. 4,660,059, issued Apr. 21, 1987 to O'Brien and entitled "COLOR PRINTING MACHINE";

U.S. Pat. No. 4,833,503, issued May 23, 1989 to Snelling and entitled "ELECTRONIC COLOR PRINTING SYSTEM WITH SONIC TONER RELEASE DEVELOPMENT";

U.S. Pat. No. 5,970,304, issued Oct. 19, 1999 to Stemmle and entitled "TWO SIDED IMAGING OF A CONTINUOUS WEB SUBSTRATE WITH A SINGLE PRINT ENGINE WITH IN LINE TRANSFER STATIONS";

U.S. Pat. No. 7,158,746, issued Jan. 2, 2007 to Swift and entitled "XEROGRAPHIC PRINTER HAVING A SEMIRESISTIVE ROTATABLE BRUSH IN THE TRANSFER ZONE"; and U.S. Pat. No. 7,242,894, issued Jul. 10, 2007 to Kuo et al. and entitled "XEROGRAPHIC TRANSFER STATION USING A BELT" are all incorporated herein by reference in their entirety.

BRIEF DESCRIPTION

In one embodiment of this disclosure, described is a continuous feed image marking apparatus comprising an image transfer belt including one or more developed images for transfer to a media web at an image transfer zone including a nip, the image transfer belts driven by a Drive Roll and an Assist Roll; the Drive Roll and Assist Roll driving the inside surface of the image transfer belt; and a Bias Transfer Roll (BTR) and one or more media web support rolls operatively associated with transferring the one or more developed images from the image transfer belt to the media web, the BTR and one or more web support rolls configured to provide a selectably engageable/disengageable nip for transferring the one or more images from the image transfer belt to the media web, the BTR and one support roll selectably camming the media web to engage/disengage the nip for transferring the one or more images from the image transfer belt to the media web, wherein, there is substantially zero wrap of the media web on the BTR during an engagement of the media web with the image transfer belt.

In another embodiment of this disclosure, described is an electrostatographic printing apparatus, comprising a charge receptor including an endless belt; a transfer nip including a BTR roll; a continuous media supplied to a transfer zone including the BTR roll, the BTR adapted for systematic engagement and disengagement with the continuous media for synchronization of image transfer from the charge receptor to the continuous media provided to the transfer zone, wherein there is substantially zero wrap of the continuous media on the BTR during the image transfer.

In still another embodiment of this disclosure, described is an electrostatographic printing apparatus, comprising a charge receptor; a transfer nip in contact with the charge receptor at a transfer zone, the transfer nip including an Assist Roll and a BTR Roll and a source of continuous media provided to the transfer zone, wherein there is substantially zero wrap of the continuous media on the BTR, a method of systematic engagement and disengagement of the continuous media in the transfer nip for synchronization of image transfer from the charge receptor to the continuous media comprising the steps of recognizing a requirement for the transfer nip to disengage from the continuous media, disengaging the continuous media from the nip, and reengaging the media with the nip.

DETAILED DESCRIPTION

Figure 1:
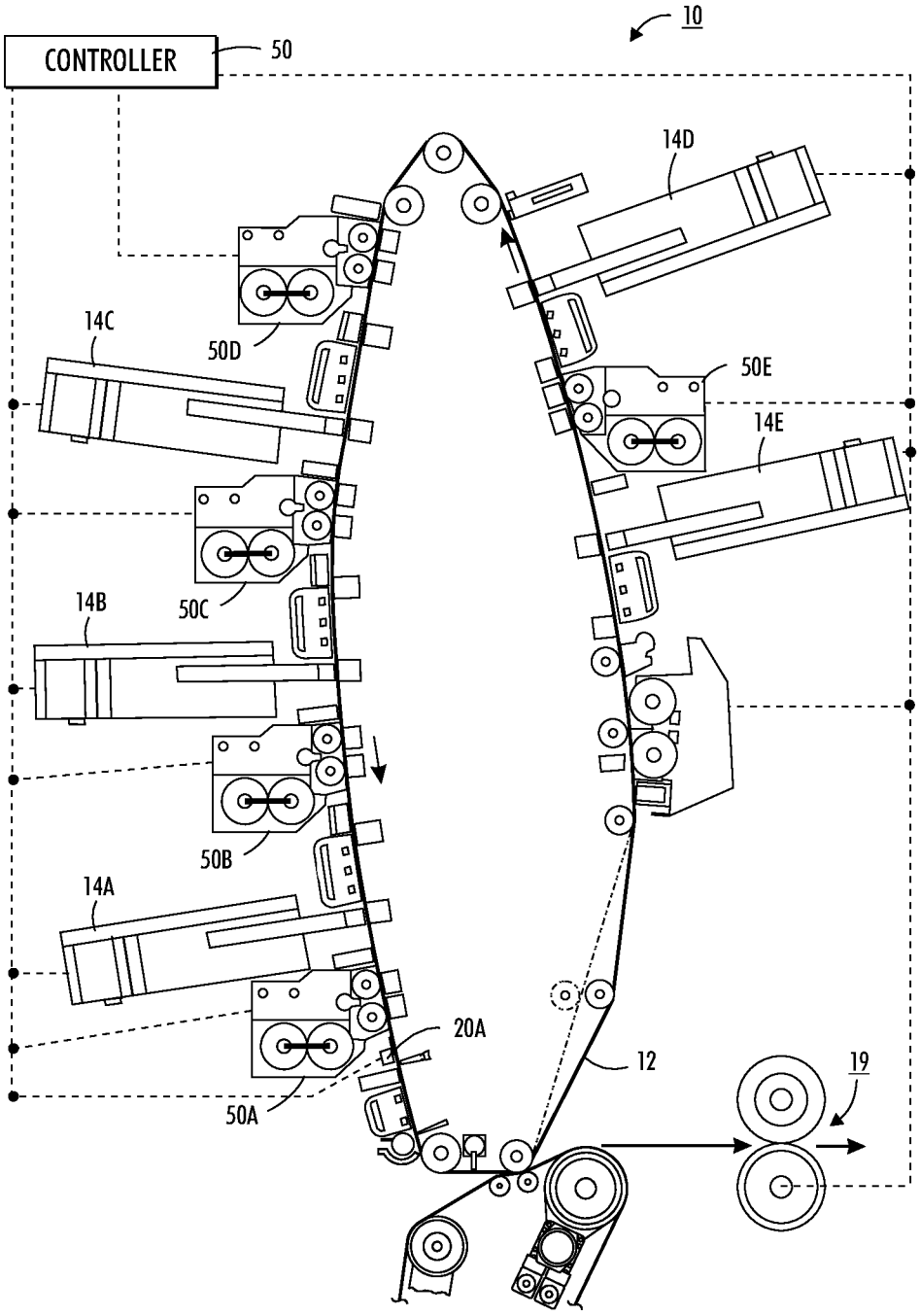
FIG. 1 illustrates an exemplary embodiment of a continuous web printing system according to this disclosure.

In accordance with this disclosure, a system is provided that uses a continuous web of stock or paper instead of cut sheet media. Various process patches on the PR (Photoreceptor) belt create inconsistencies with the media feed, for example, a label dimension or seam that require timing and coordination. A BTR roll provides a relatively small nip at the transfer zone or station and the paper web is separated from the BTR nip. The well-defined nip edges allow for accurate timing of the registration between the PR belt and web media. The web is stopped and reversed, then reversed again to reunite with the PR belt. The timing of the BTR roll engagement after reversing allows for synchronization of the turn on of the field in the gap between images without creating toner disturbances due to air breakdown. The web reversal is known as a Pilgrim Step in the label industry because the imaging drums have image seams that must be avoided to keep the labels at an even pitch.

Provided is a novel design for the control of the geometry of the media web in the transfer zone of a continuous feed label press. Conventionally, the transfer nip design includes the media web wrapping around the biased transfer roller (BTR). Since the media is under tension, and the BTR consists of a thick, conformable conductive foam layer surrounding an electrically connected rigid metal shaft, the foam will compress due to the forces applied through the shaft assembly. It is proposed here that this compression will be non-uniform and may negatively impact the uniformity of the width of the contact nip when the BTR brings the media into pressured contact with the photoreceptor belt. In addition, it is proposed here that this may lead to image and motion quality non-uniformities. To solve this problem, the disclosed image transfer design for a continuous web includes a media web not wrapping on the BTR foam, thereby eliminating the foam compression due to the tension in the media web.

According to one exemplary embodiment, a contiguous label press requiring the marriage of a PR continuous polyimide belt with a label stock (paper release/paper label or polymer release/polymer label) open loop web is described. The transfer of the xerographic image from the PR belt to the paper occurs at the PR belt assist drive roller. The PR belt has a seam that cannot be imaged. Therefore, a periodic retraction/engagement-disengagement of the web is necessary to skip the seam which requires the paper to reverse and reengage to maintain a uniform gap label pitch between labels. Otherwise, a significant amount of waste will occur in the final label product stream. When the BTR is engaged to the PR assist roll it must perform only one function, that is to transfer the image from the PR belt to the paper. If the exit web exerts any Tension/BTR Radius pressure on the foam the nip will be unstable causing motion/banding artifacts.

To maintain a uniform nip width, this disclosure provides the geometry and entrance and exit angles to provide functional isolation of the BTR foam/label media/PR belt interface. The field exerted on the toner at transfer is related to the mechanical width of the nip as well as other electrostatic material conductive properties. If the label web is wrapped on the BTR and tension variations exist between the vacuum pull roll and the metering roll due to eccentricities, tension and velocity control in the web path, the T/R pressure changes on the BTR. If the BTR foam roller has a small wrap angle, this T/R pressure is 2 psi at 1 pli web tension. The nip pressure generated is ~8 psi. Therefore, more load will need to be applied to create the 3 mm nip for the transfer nip to balance the T/R pressure and tighter control of the tension will be required to prevent the foam nip from deflecting/changing while printing.

To print a continuous stream of labels with a constant gap between labels, this gap could be as small as 3 mm. In order to achieve this, a skip pitch problem arises due to the PR belt seam. To eliminate excessive material waste due to the PR seam, the web is required to periodically retract via a 'pilgrim step movement' disengage BTR, decel, reverse, accel, and engage BTR from the PR belt so that the seam will not be "printed" on the web. This coordinated motion of the label web will ensure that the gap is constant between labels. The goal of the pilgrim step registration is the industry standard of ±150 um in both process and cross track directions. In order to achieve the registration careful control of the tension is essential. This disclosure and the exemplary embodiments provided herein address the tension control by keeping the web span lengths the same during the pilgrim step motion.

FIG. 1 schematically illustrates an exemplary printer 10 as one example of an otherwise known type of xerographic, plural color "image-on-image" (IOI) type full color (cyan, magenta, yellow and black imagers) reproduction machine, merely by way of one example of the applicability of the disclosed image transfer design. A partial, very simplified, schematic perspective view thereof is provided in FIG. 2. This particular type of printing is also referred as "single pass" multiple exposure color printing. It has plural sequential ROS beam sweep PR image formations and sequential superposed developments of those latent images with primary color toners, interspersed with PR belt re-charging. Further examples and details of such IOI systems are described in U.S. Pat. Nos. 4,660,059; 4,833,503; and 4,611,901.

However, it will be appreciated that the disclosed systems could also be employed in non-xerographic color printers, such as ink jet printers, or in "tandem" xerographic or other color printing systems, typically having plural print engines transferring respective colors sequentially to an intermediate image transfer belt and then to the final substrate. Thus, for a tandem color printer it will be appreciated the image bearing member on which the subject registration marks are formed may be either or both on the photoreceptors and the intermediate transfer belt, and have MOB sensors and image position correction systems appropriately associated therewith. Various such known types of color printers are further described in the above-cited patents and need not be further discussed herein.

Figure 2:
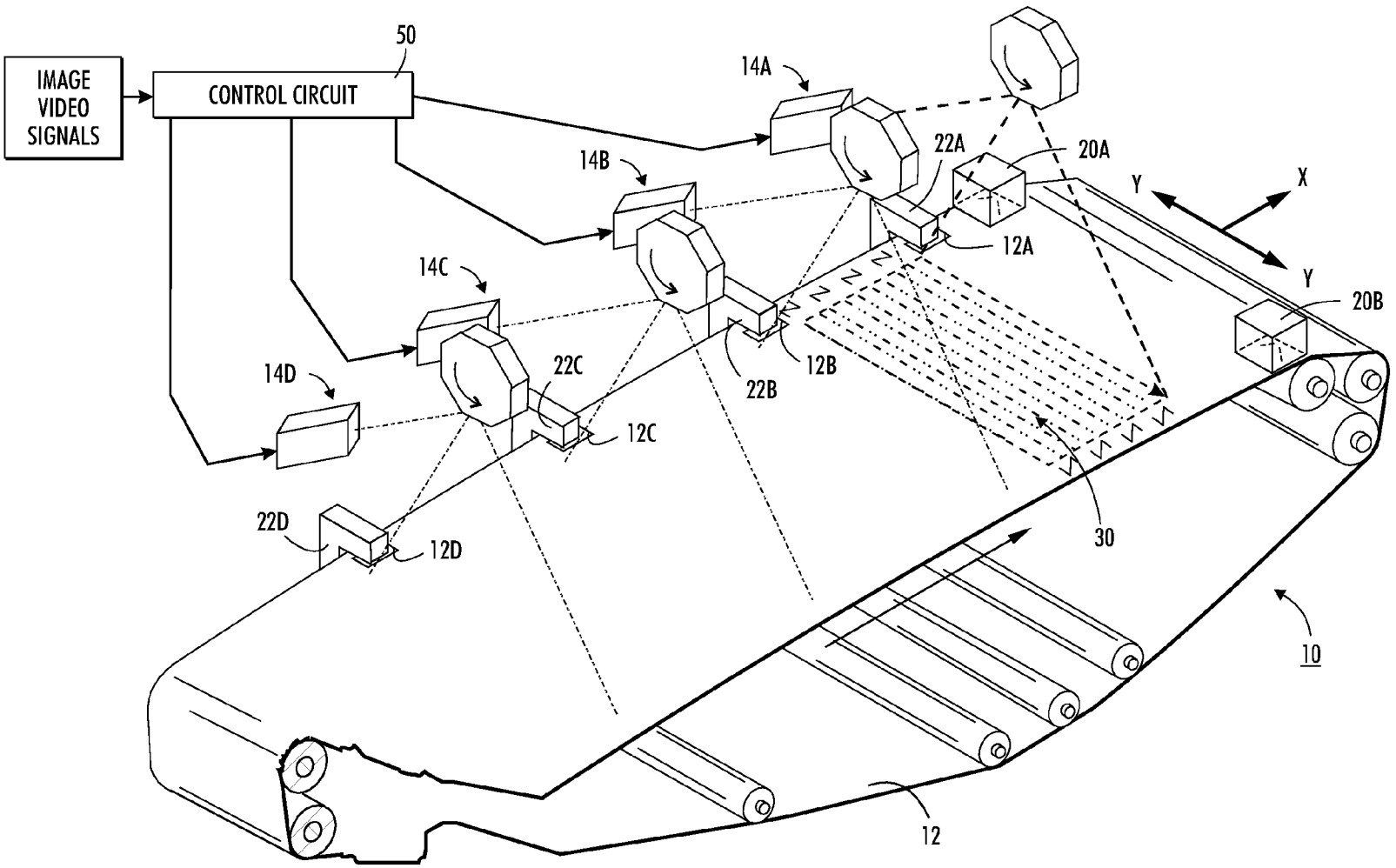
FIG. 2 illustrates another view of an exemplary embodiment of a photoreceptor belt, including a seam, according to this disclosure.

Referring to the exemplary printer 10 of FIGS. 1 and 2, all of its operations and functions may be controlled by programmed microprocessors, as described above, at centralized, distributed, or remote system-server locations, any of which are schematically illustrated here by the controller 50. A single photoreceptor belt 12 may be successively charged, ROS (raster output scanner) imaged, and developed with black or any or all primary colors toners by a plurality of imaging stations. In this example, these plural imaging stations include respective ROS's 14A, 14B, 14C, 14D, and 14E; and associated developer units 50A, 50B, 50C, 50D, and 50E. A composite plural color imaged area 30, as shown in FIG. 2, may thus be formed in each desired image area in a single revolution of the belt 12 with this exemplary printer 10, providing accurate registration can be obtained. Two MOB sensors (20A in FIG. 1, 20A and 20B in FIG. 2) are schematically illustrated, and are provided for proper registration.

In embodiments, developer units 50A-50D are used to develop black, cyan, yellow, and magenta, respectively. These separate color images (usually called color separations) are developed successively with appropriate time delays so that they become overlapped on the photoreceptor belt before being transferred to a sheet of paper.

The belt 12 has a conventional drive system 16 for moving it in the process direction shown by its movement arrows. A transfer station 18 is illustrated for the transfer of the composite color images to the final substrate, a continuous media web, which then is fed to a fuser 19 and outputted.

Referring to FIG. 2, it may be seen that registration holes 12A, 12B, 12C, 12D, etc., (or other permanent belt marks, of various desired configurations) may also be provided along one or both edges of the photoreceptor belt 12. These holes or marks may be optically detected, such as by belt hole sensors, schematically shown in this example in FIG. 2 as 22A, 22B, 22C, 22D. Various possible functions thereof are described, for example, in the above-cited patents. If desired, the holes or other permanent belt markings may be located, as shown, adjacent respective image areas, but it is not necessary that there be such a mark for each image position, or that there be plural sensors. Also, the number, size and spacing of the image areas along the photoreceptor belt may vary in response to various factors including, for example, when larger or smaller images are being printed.

Figure 3:
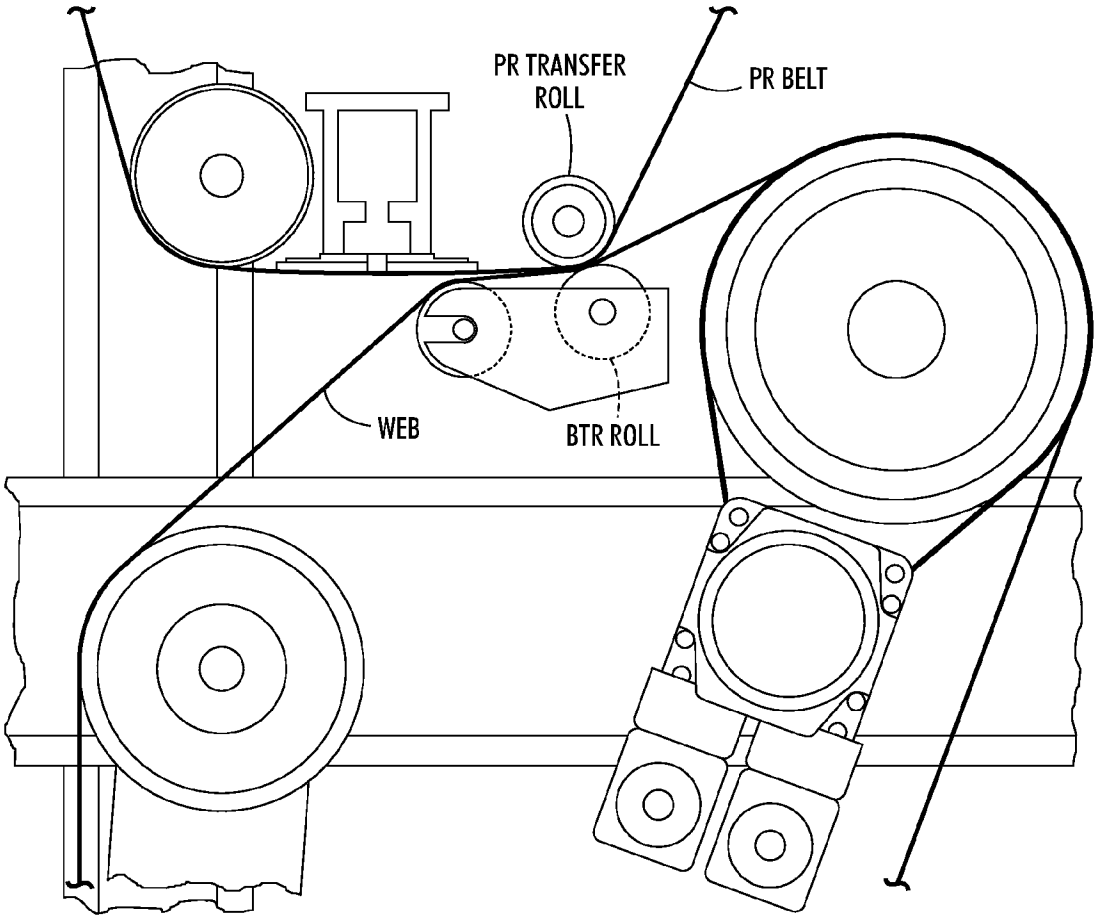
FIG. 3 illustrates an exemplary embodiment of an image transfer mechanism, according to this disclosure, including a zero wrap BTR.

One of the exemplary configurations of an image transfer station is shown in FIG. 3 where the BTR roll is pivoted away from the PR transfer roll. In this approach, whenever the web is retracted, the web becomes slacked due to the length change. The web tension may be hard to control because of the speed at which the retract and engage occur ~30 to 40 ms. To achieve small tension variation during the pilgrim step, moves by changing the servo timing can be difficult to control.

Figure 4:
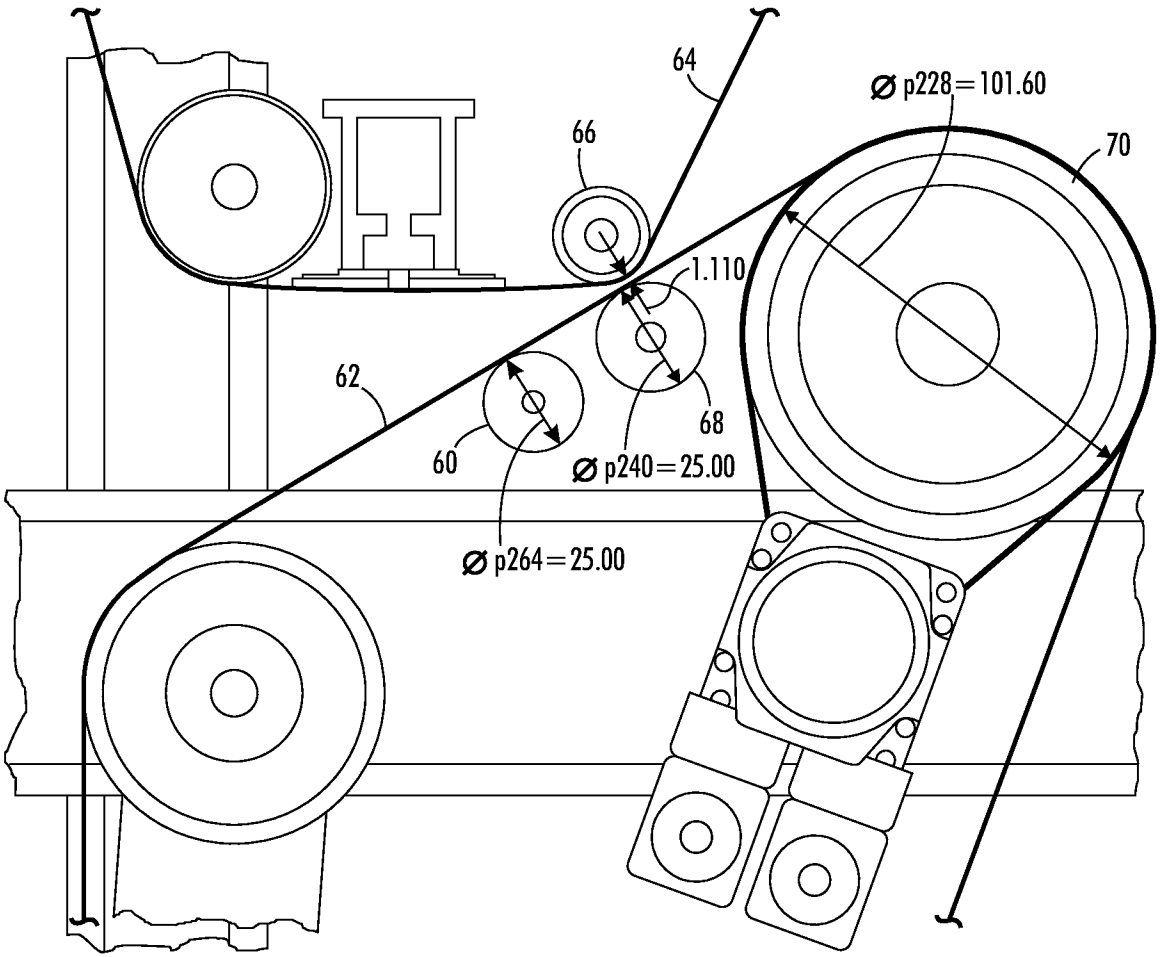
FIG. 4 illustrates another exemplary embodiment of an image transfer mechanism, according to this disclosure, including a zero wrap BTR retracted from the PR belt.
Figure 5:
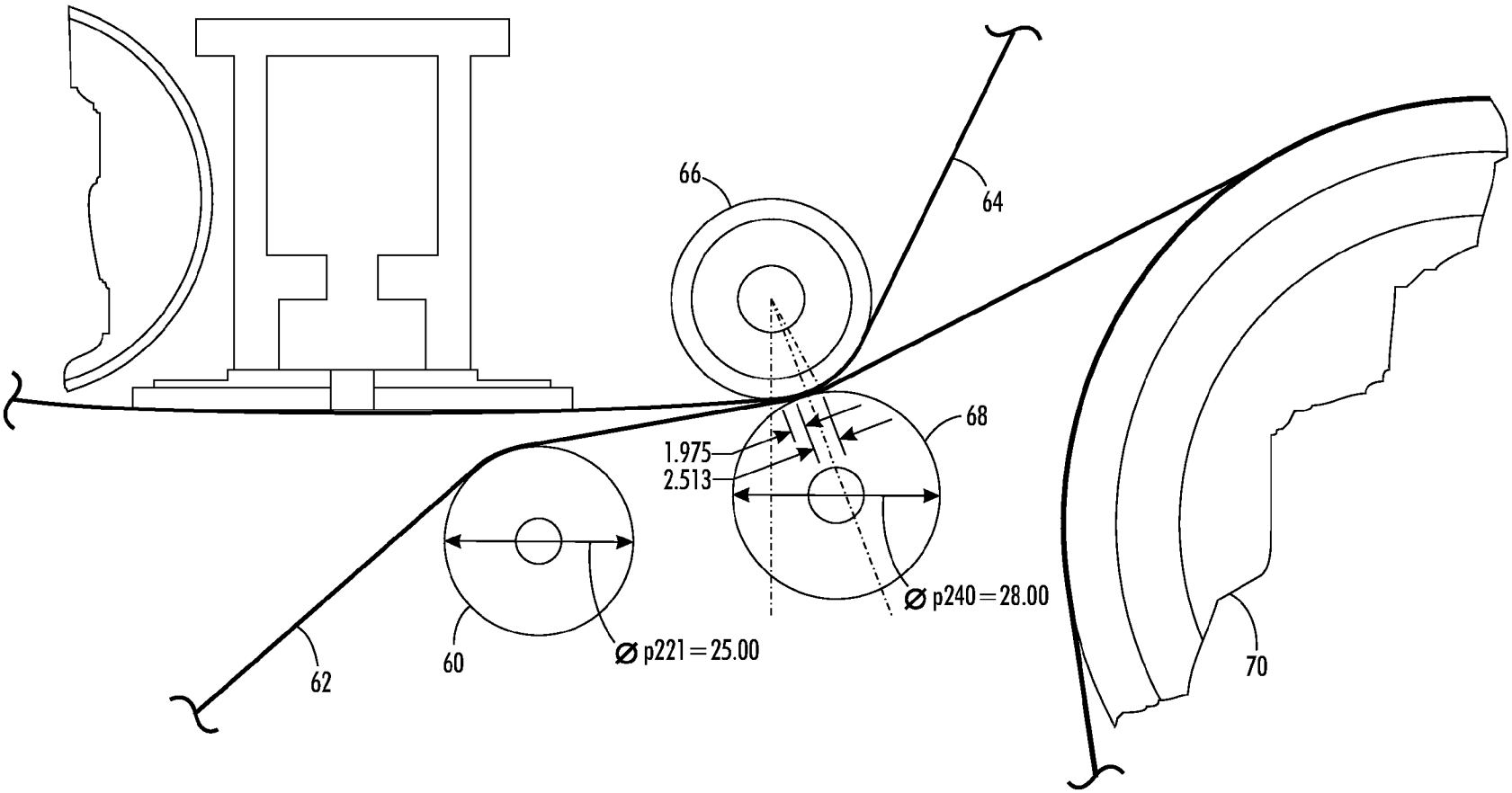
FIG. 5 illustrates another exemplary embodiment of an image transfer mechanism, according to this disclosure, including a zero wrap BTR engaging the PR belt.

FIGS. 4 and 5 show another exemplary image transfer design that uses a single support roll 60 to manage the label stock associated with a continuous media web 62 with 2 mm of web to PR belt 64, prewrap on the PR assist drive roll 66 when engaged (FIG. 5). When the label web is dis-engaged from the PR belt 64 the label stock maintains 4 deg of wrap on the support roll 60, 0 deg wrap on the driven BTR roll 68, and directly tangent to the vacuum pull roll 70 (FIG. 4). The difference in span lengths in the baseline configuration is ~4.5 mm. The key to this design is to avoid any wrapping of the label stock web on the BTR foam roller 68 that could provide nip instability during steady state printing.

FIG. 5 shows the BTR engaged and the label media wrapped on the PR assist roll 66 with 20 deg. The media exit angle on the PR assist roll 66 is at the tangent of the BTR roll 68 to PR assist nip. This configuration ensures zero media wrap on the BTR roll 68 while printing.

The disclosed image transfer mechanisms address the geometry of the vacuum roll and support roll wrap angles, entrance and exit spans to ensure that all the wrap occurs on the PR assist roll and zero wrap on the BTR roll. By wrapping only the PR assist roll there are no T/R pressures exerted on the foam.

Notably, the natural design tendency is to place the vacuum pull roll lower such that it is below the PR belt plane. This allows for less displacement of the transfer deck system when the PR module slides to the right and comes out of the module for belt replacement. Enforcing a zero wrap condition on the BTR roller during printing puts the vacuum pull roll higher and the support roll lower. A swing away mechanism must drop further to miss the PR module. Therefore, the BTR roller's only function is to create a nip and will not be required to manage a T/R pressure force exerted by the web during printing.

Figure 6:
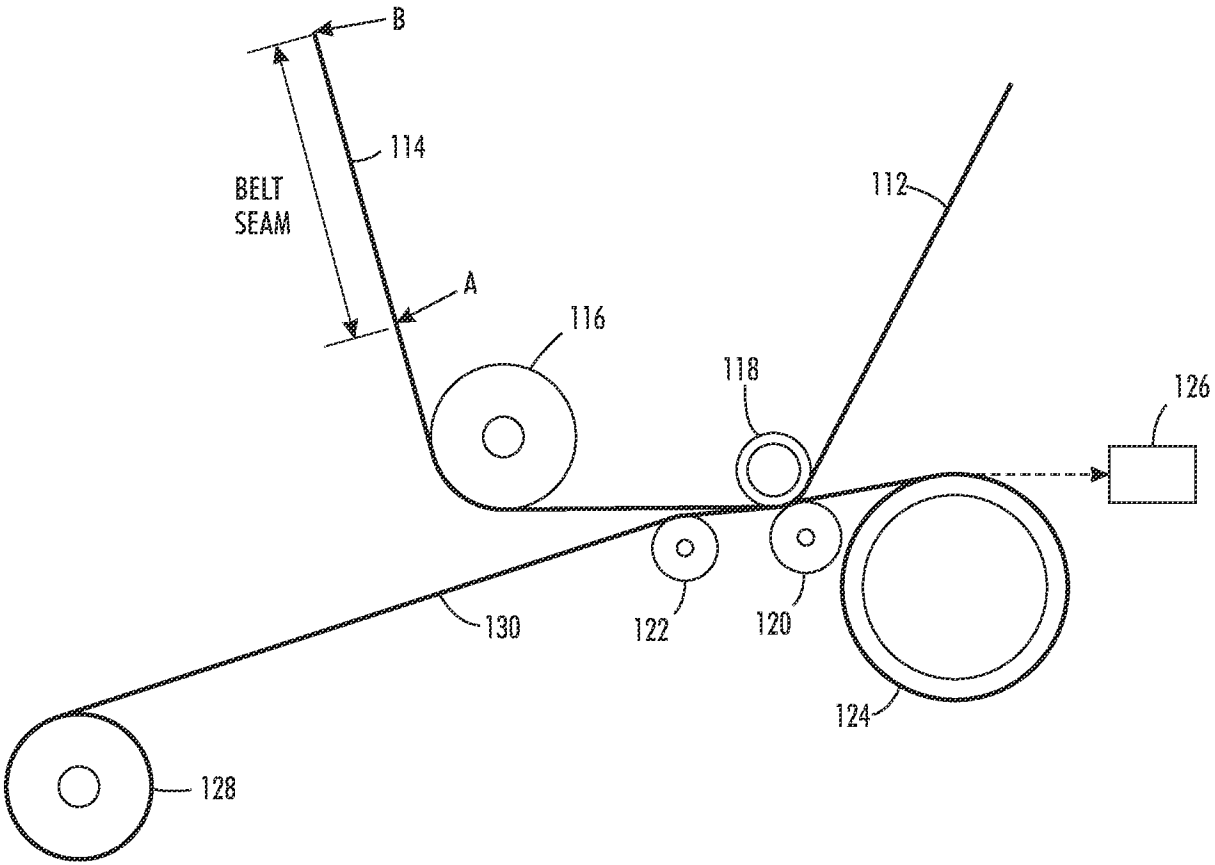
FIG. 6 illustrates a belt seam (or test patch or label pitch) approaching the transfer BTR.

With reference to FIG. 6, there is illustrated an endless photoreceptor belt 112 as it passes through the image transfer station of a high speed xerographic imaging machine, including a continuous media web 130. The PR belt 112 is shown with a belt seam portion 114 extending between points A and B. The main drive of the belt 112 is shown at 116 driving the belt through the image transfer station including auxiliary stripper roll 118, biased transfer roll (BTR) 120, and wringer roll 122. The auxiliary stripper roll 118 sets an approach angle of the continuous media web into the nip with the BTR 120.

The system, as shown in FIG. 6, is in a continuous printing or imaging state with the nip engaged, however, the belt seam (test patch or a residual label pitch) is approaching the nip. Importantly, images are not projected on the seam and therefore the nip must be disengaged as the seam passes through the nip. The PR belt 112, as shown, illustrates the nip of BTR roll 118 and stripper drive 120 engaging the PR belt and forming a nip during normal printing, as the seam 114 approaches the main drive 116 with lead edge A followed by trail edge B.

It should be noted that, generally, a bias transfer roll 120 is provided for establishing a directional force field capable of attracting toner particles from a photoconductive surface to a copy substrate, such as a continuous media web, that is subsequently transported to a fusing station. The bias transfer roll electrically attracts charged toner particles from the photoconductive surface such as a PR belt, to transfer the developed images on the photoconductive surface of the belt to the continuous web positioned in the transfer nip. The BTR roll is generally formed of an open cell foam which is electrically conductive. An electrical biasing device in the form of a constant current or voltage supply source is generally electrically coupled to the conductive core for providing the electrical bias. The bias is either a constant current or a constant voltage source.

PR drive assist stripper roll 118 and BTR roll 120 form a nip to receive an imaging medium such as a continuous paper web 130, driven by a vacuum roll drive 124 and low lateral force or idler roll 128 conveying the continuous paper web 130 to the transfer station nip 118, 120. The low lateral force roll 128 with suitable strain gauge along with vacuum roll drive 124 provide suitable tension 1 to 1.5 pli on the continuous paper feed roll to convey the paper through the transfer nip to receive images from the belt 130.

The vacuum roll drive 124 applies suitable vacuum pressure to pull the paper against the roll and the images on the web 130 are then carried to a suitable fuser station 126. The web 130 makes contact roughly 2 mm prior to the field from the BTR 120 to prevent pre-nip breakdown. At this point, the wringer roll 122 is up and the wrap angle of the web 130 around the BTR 120 at the exit of the nip is about 1.5 degrees.

Figure 7:
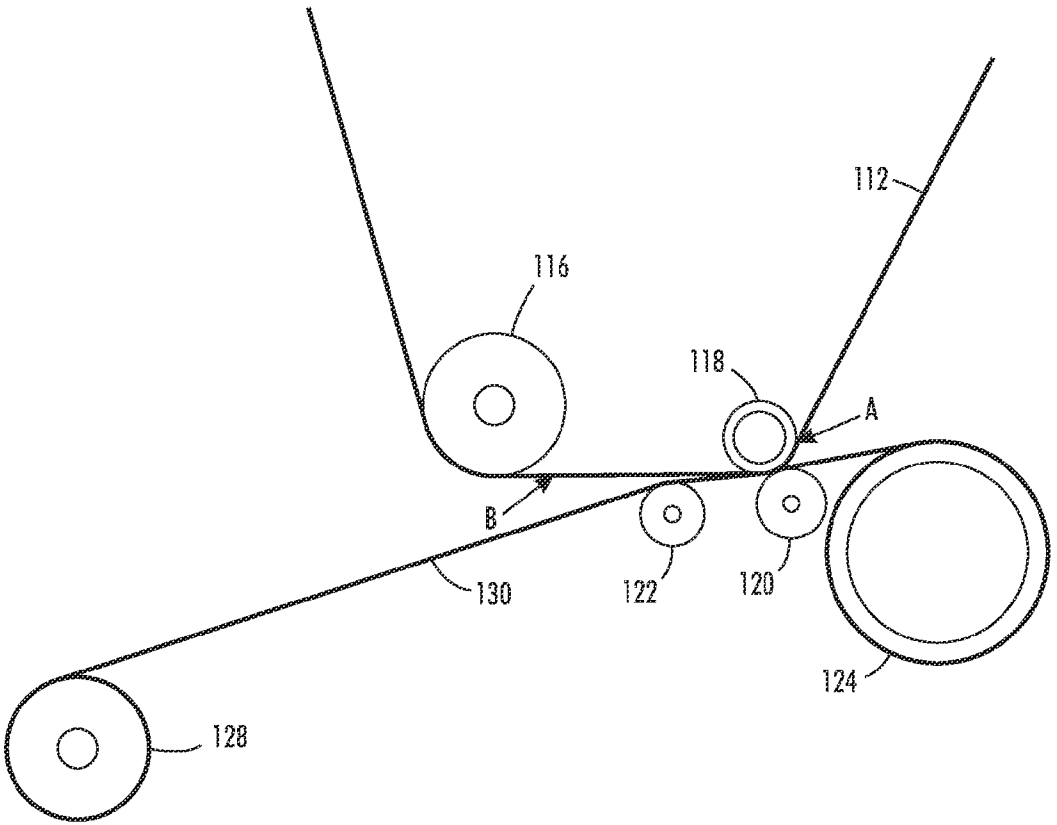
FIG. 7 shows the lead edge (A) of the seam area has just passed the BTR field on the nip exit edge.
Figure 8:
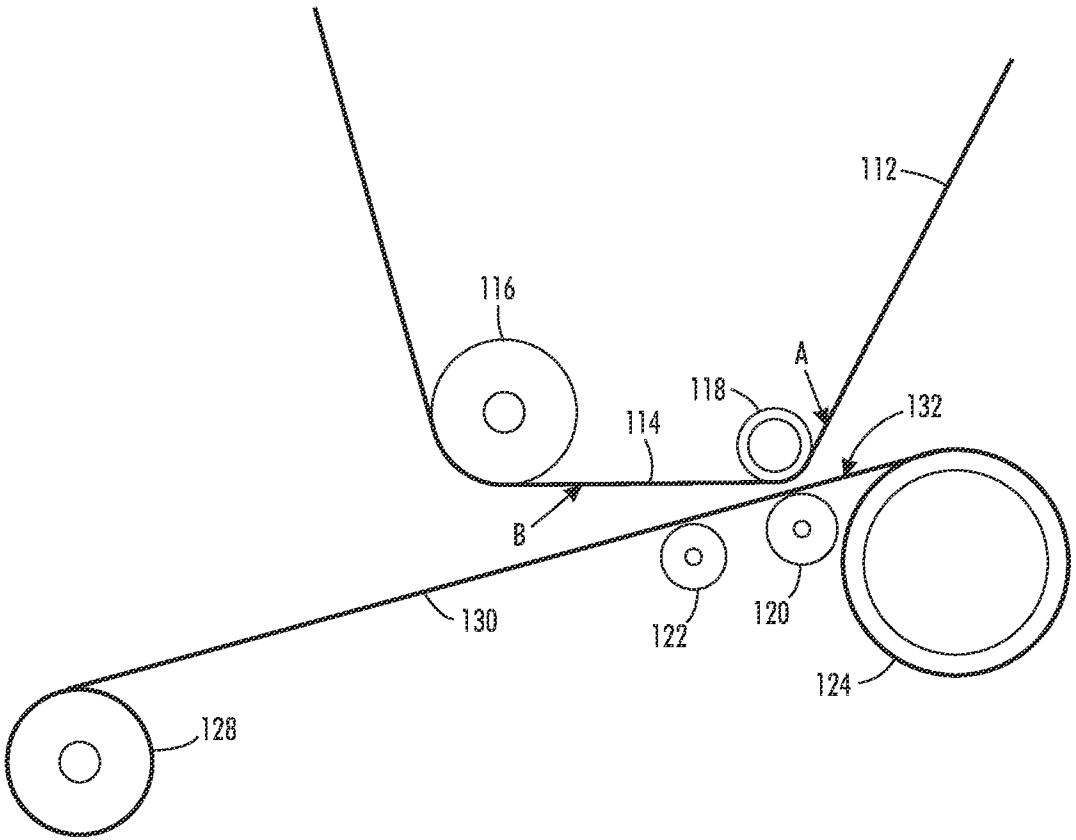
FIG. 8 is showing a wringer roll (122) and BTR (20) drop to disengage the web from the imaging belt as the web motion is decelerated.

With reference to FIGS. 7 and 8, the lead edge A of the seam has just passed the BTR field at the nip exit as shown in FIG. 7. Also, as shown in FIG. 8, the BTR 120 and wringer roll 122 have been dropped away from the belt 112 to increase the wrap of the web 130 on the BTR 120. The BTR 120 is turned off and as the web 130 is decelerated, the wrap angle is about 3.0 degrees.

Figure 9:
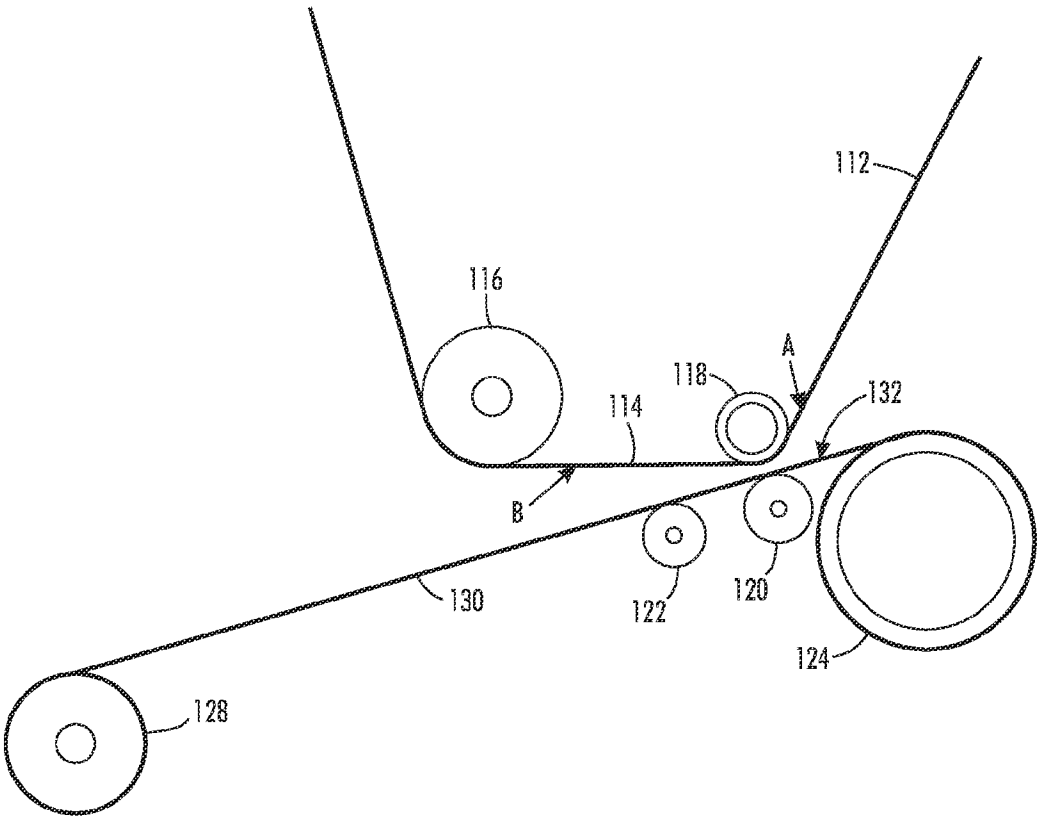
FIG. 9 illustrates the continuing wringer and BTR drop before the web is ready to be reversed, the PR belt continues to traverse the seam.
Figure 10:
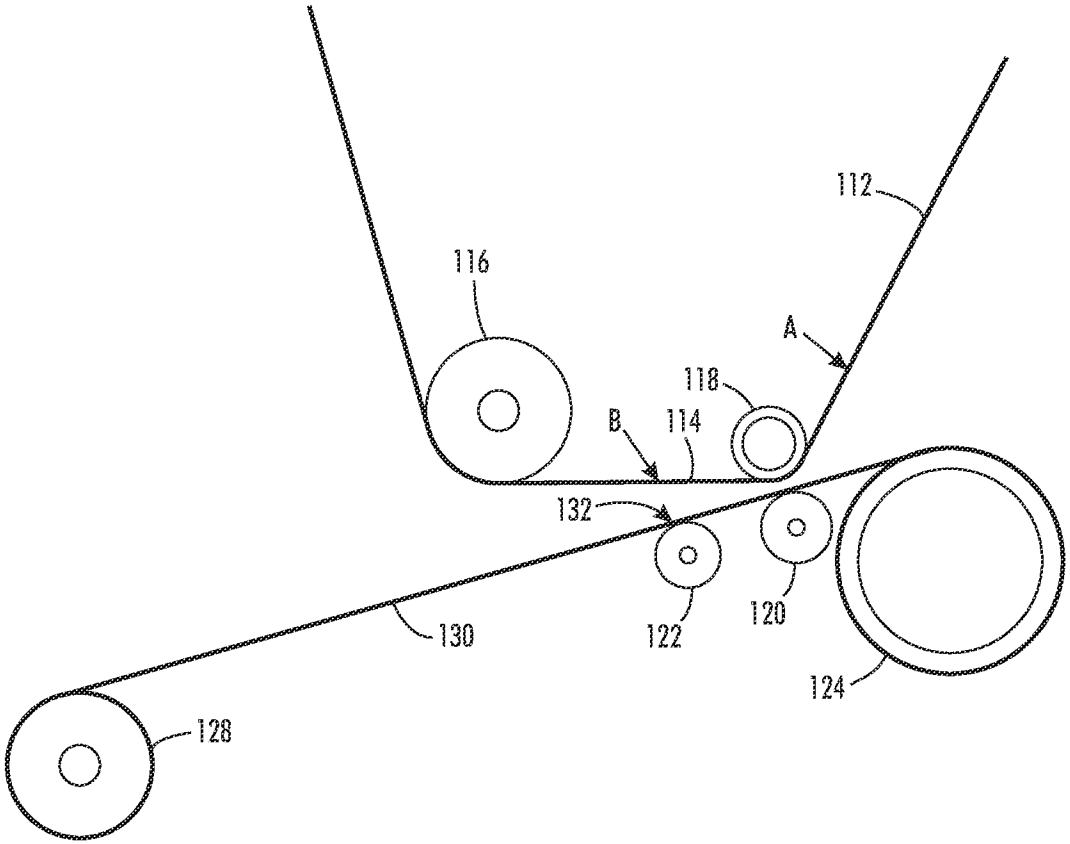
FIG. 10 illustrates web reversal.

With reference to FIGS. 9 and 10, the wringer 122 and BTR 120 continue to drop away from the belt 112 as the seam 114 is passing through the nip and the direction of the web 130 is ready to be reversed. For reference, the trail edge of the last image transferred to the web 130 at the transfer station is illustrated at 132 in FIG. 9. It is then necessary to reverse the direction of the web 130 to move the trail edge to a location prior to the transfer nip. This is required in order to synchronize the placement of the first image after the seam 114 on the web 130 in suitable relationship with the last image on the web 130.

FIG. 10 illustrates the location of the trail edge 132 of the last image transferred to the web 130 at the transfer station after the web 130 direction has been reversed and the trail edge repositioned. It should be noted that the photoreceptor belt 112 continues its normal movement and the web 130 is separated from the belt 112 during this repositioning period.

Figure 11:
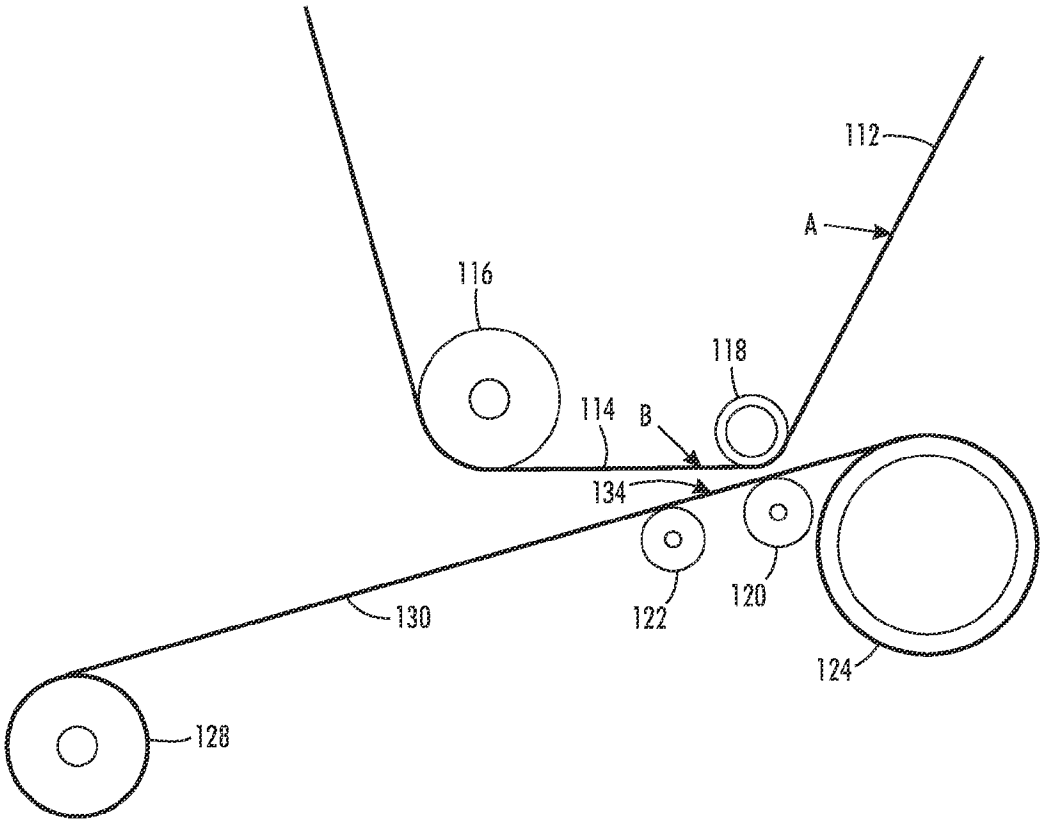
FIG. 11 shows web acceleration and timing to reunite the image on the PR with the next pitch or proper web location.

With reference to FIG. 11, the web 130 is now being accelerated forward and timed to reunite the lead edge of the next image on the belt 112 with the correct position on the web 130 in relation to the image on the web that had been reversed. That is, the next image from the belt 112 to the web 130 will have its lead edge on the web 130, illustrated at 134. However, the nip is not yet closed and the lead edge position 134 has not yet reached the transfer station nip.

Figure 12:
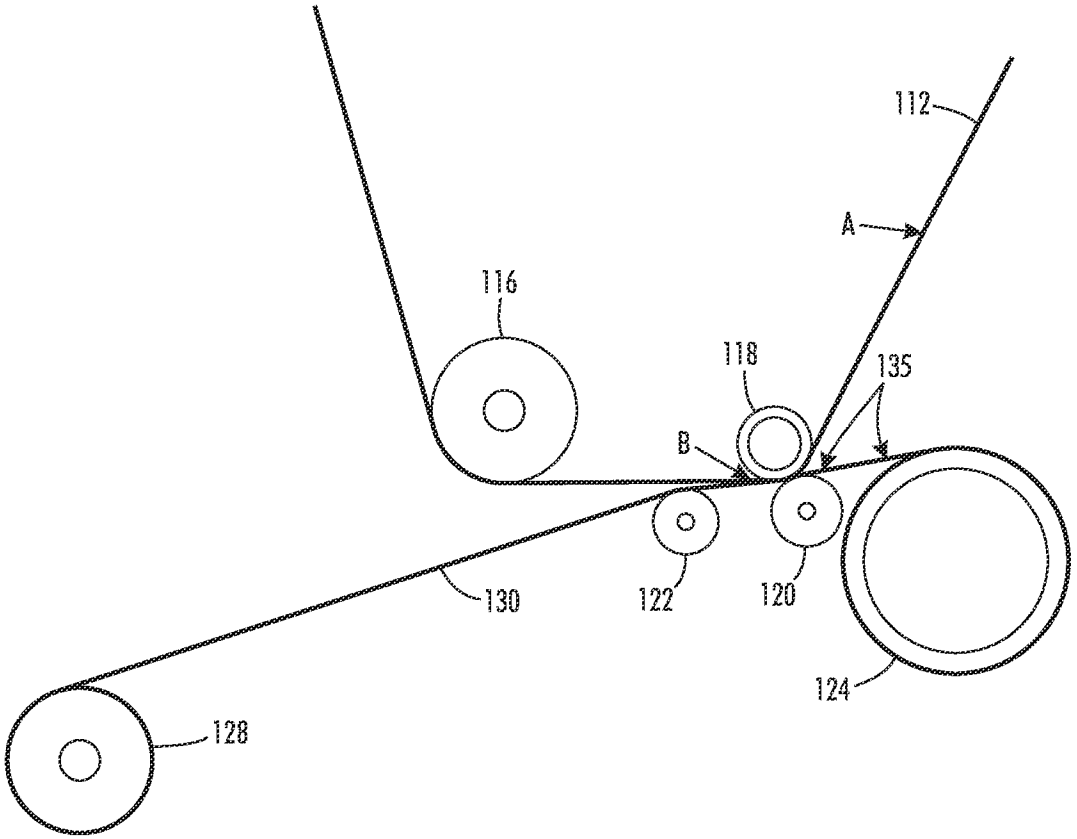
FIG. 12 shows the wringer and BTR raised, tension reduced on the web, the trail edge of the seam passing thru the nip area with the BTR energized.
Figure 13:
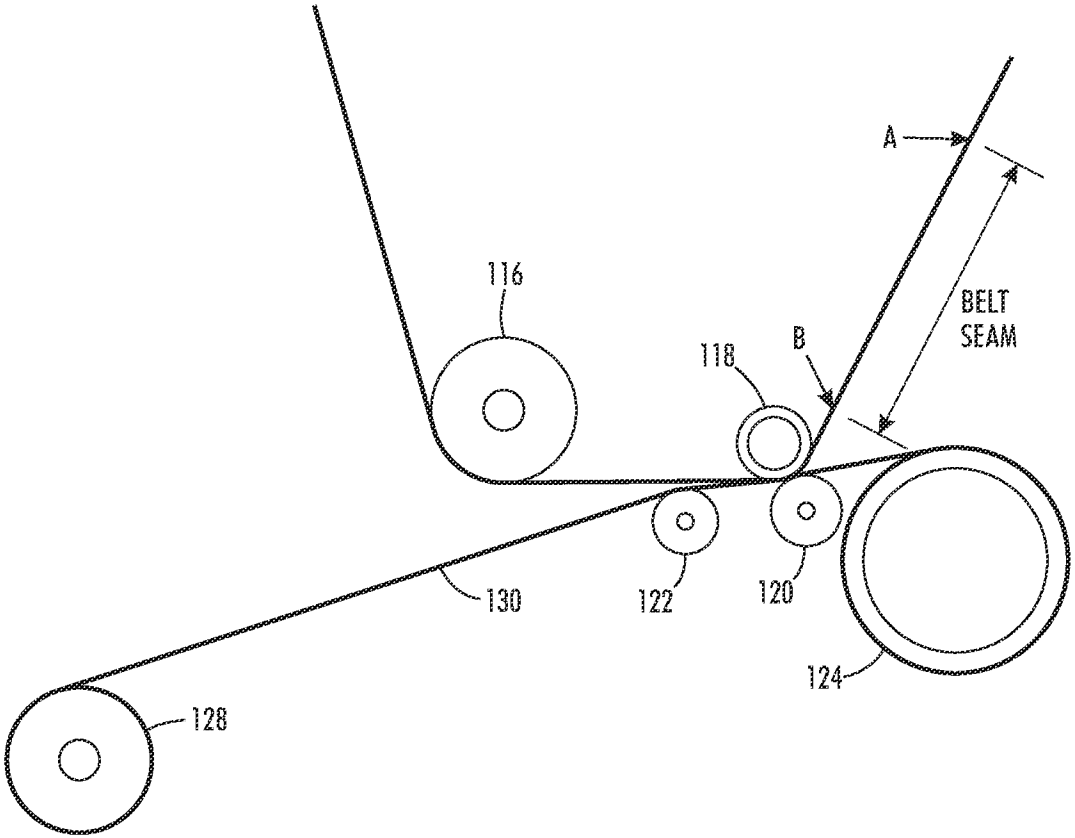
FIG. 13 illustrates the printer resuming operation.

With reference to FIG. 12, the wringer 122 and BTR 120 are raised and the nip 118, 120 is closed. The end of the seam passes through the nip and the BTR 120 is turned on prior to the lead edge of the next image arriving in the nip. The next image will be transferred to web 130 and to follow the previous image that had been transferred and reversed on the web, shown at 135. The web 130 again operates under the forward direction tension. FIG. 13 merely shows the resumption of normal imaging and transfer after the passage of the seam.

Figure 14:
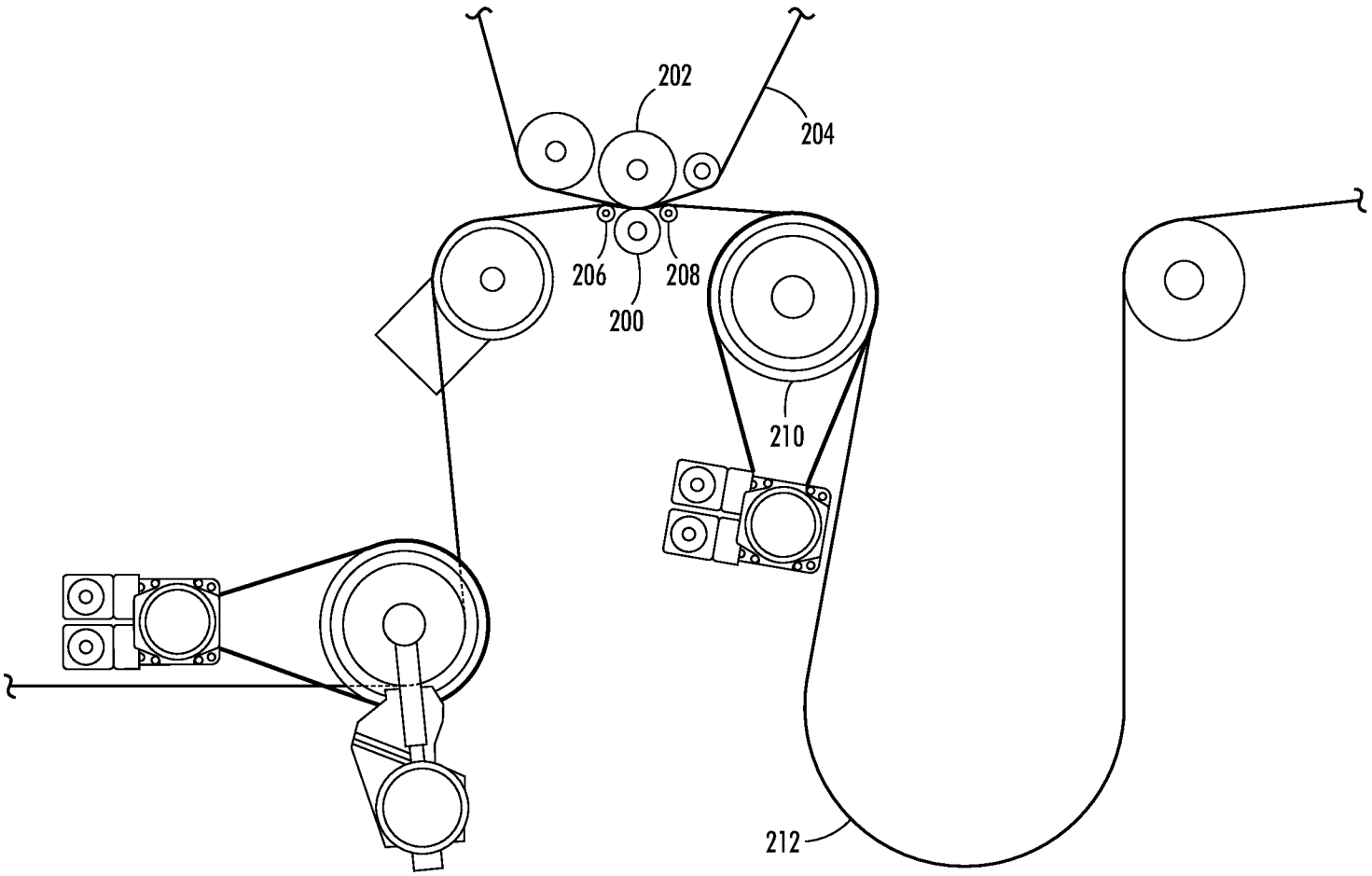
FIG. 14 illustrates an image transfer station.
Figure 15:
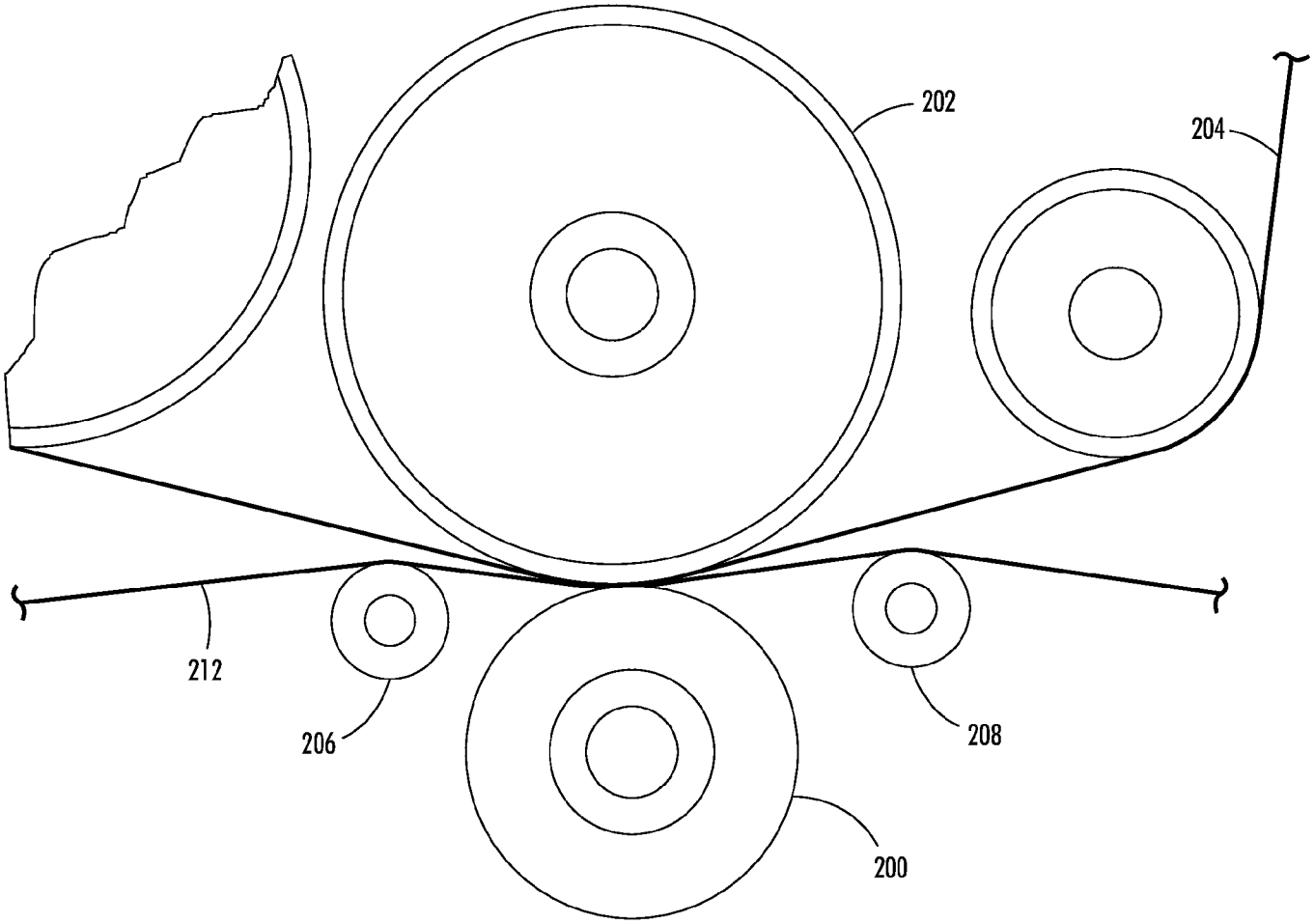
FIG. 15 illustrates an enlarged view of an image transfer station as illustrated in FIG. 14, where the PR belt and continuous media web are engaged.
Figure 16:
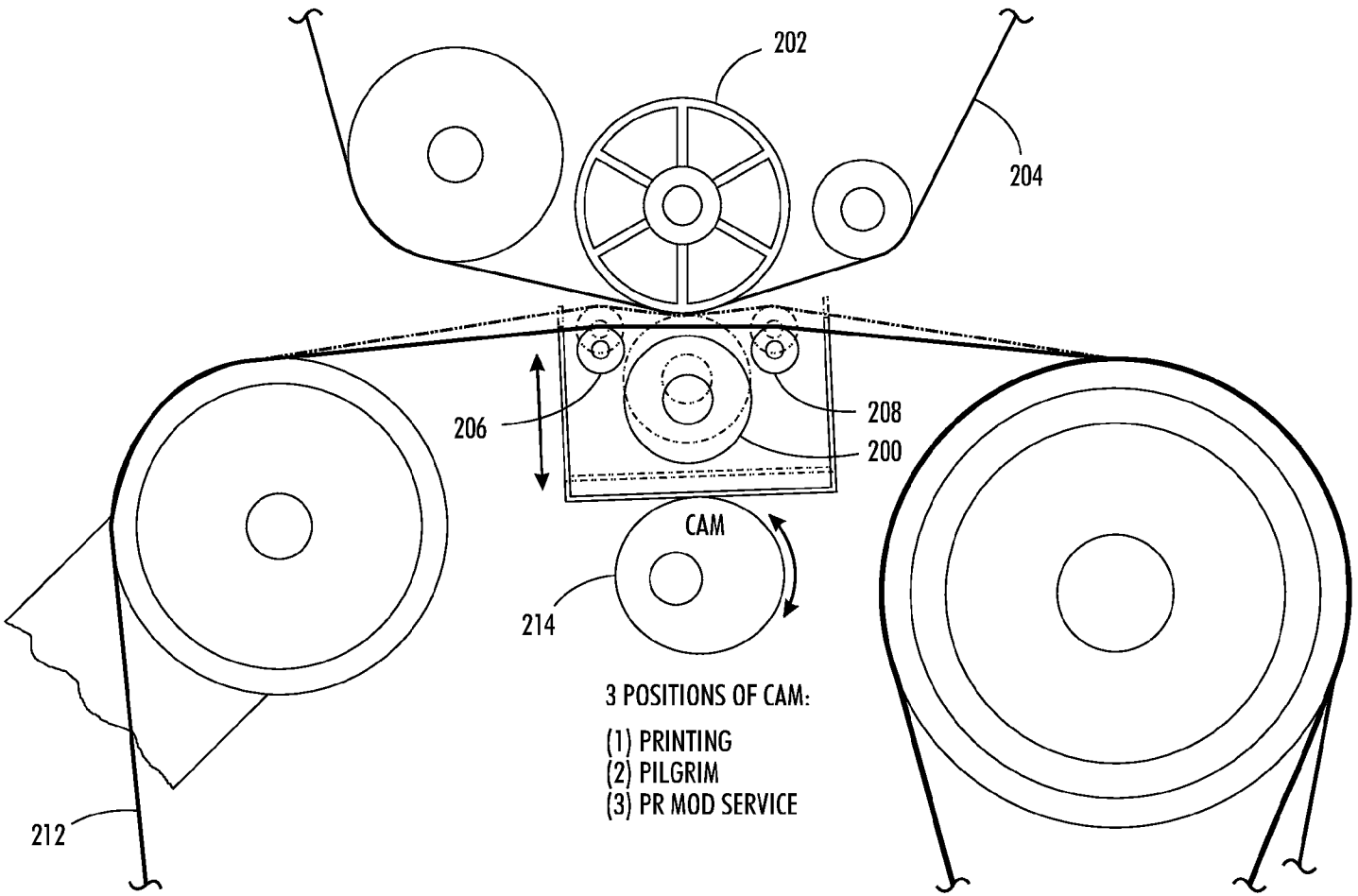
FIG. 16 illustrates another exemplary embodiment of an image transfer station.

Another embodiment of the BTR transfer is shown in FIGS. 14, 15 and 16. The BTR 200 is moved upstream and operates opposite an idler roll 202 inside the PR web 204. The BTR roll 200 is proximately located to two support idlers 206 and 208. There exists load motion between the two outside support rolls 206 and 208, and the BTR roll 200. The support rolls rise to engage the PR web as shown in FIG. 14 and continuous media web 212. The BTR roll 200 follows creating the 3 to 5 mm nip at the time the lead edge is introduced. The length of web change is reduced, the vacuum roll 210 is placed so that it does not have to drop away, and the total lift travel is less, accommodating faster engagement and release times.

FIG. 15 illustrates an enlarged view of an image transfer station as illustrated in FIG. 14, where the PR belt and continuous media web are engaged.

With references to FIG. 16, illustrated is another exemplary embodiment of an image transfer station as described above and illustrated in FIGS. 14 and 15. As shown in FIG. 16, this arrangement includes a cam 214 which includes three positions, (1) Printing, (2) Pilgrim and (3) PR Mod Service It should be understood that the above disclosure for the handling of a web seam is merely exemplary of different situations such as avoiding test patches and different formats for label printing and the disclosure is intended to cover a wide range of applications and teachings dealing with continuous web printing and adjustment for situations requiring a deviation from routine operation.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A continuous feed image marking apparatus comprising:

an image transfer belt including one or more developed images for transfer to a media web at an image transfer zone including a nip, the image transfer belt driven by a Drive Roll and an Assist Roll; the Drive Roll and Assist Roll driving an inside surface of the image transfer belt; and a Bias Transfer Roll (BTR) and one or more media web support rolls operatively associated with transferring the one or more developed images from the image transfer belt to the media web at the image transfer zone, the BTR and one or more media web support rolls configured to provide a selectably engageable/disengageable nip for transferring the one or more images from the image transfer belt to the media web, the BTR and one or more media support rolls selectably camming an inside surface of the media web to engage/disengage the nip for transferring the one or more images from the image transfer belt to the media web, wherein the BTR and one or more media support rolls are configured to provide substantially zero wrap of the media web on the BTR during an engagement of the media web with the image transfer belt, and wherein the Drive Roll is larger in diameter than the Assist Roll.

2. The continuous feed image marking apparatus according to claim 1, comprising:

a controller operatively connected to the Drive Roll, the Assist Roll and the BTR, the controller configured to disengage the BTR from the image transfer zone and engage the BTR for transfer of an image from the image transfer belt to the media web.

3. A continuous feed image marking apparatus comprising:

an image transfer belt including one or more developed images for transfer to a media web at an image transfer zone including a nip, the image transfer belt driven by a Drive Roll and an Assist Roll; the Drive Roll and Assist Roll driving an inside surface of the image transfer belt; and a Bias Transfer Roll (BTR) and one or more media web support rolls operatively associated with transferring the one or more developed images from the image transfer belt to the media web at the image transfer zone, the BTR and one or more media web support rolls configured to provide a selectably engageable/disengageable nip for transferring the one or more images from the image transfer belt to the media web, the BTR and one or more media support rolls selectably camming an inside surface of the media web to engage/disengage the nip for transferring the one or more images from the image transfer belt to the media web, wherein the BTR and one or more media support rolls are configured to provide substantially zero wrap of the media web on the BTR during an engagement of the media web with the image transfer belt, and wherein the BTR and a proximately located Support Roll are configured to pivot about a BTR axis to engage/disengage the nip.

4. The continuous feed image marking apparatus according to claim 3, comprising:

a controller operatively connected to the Drive Roll, the Assist Roll and the BTR, the controller configured to disengage the BTR from the image transfer zone and engage the BTR for transfer of an image from the image transfer belt to the media web.

5. A continuous feed image marking apparatus comprising:

an image transfer belt including one or more developed images for transfer to a media web at an image transfer zone including a nip, the image transfer belt driven by a Drive Roll and an Assist Roll; the Drive Roll and Assist Roll driving an inside surface of the image transfer belt; and a Bias Transfer Roll (BTR) and one or more media web support rolls operatively associated with transferring the one or more developed images from the image transfer belt to the media web at the image transfer zone, the BTR and one or more media web support rolls configured to provide a selectably engageable/disengageable nip for transferring the one or more images from the image transfer belt to the media web, the BTR and one or more media support rolls selectably camming an inside surface of the media web to engage/disengage the nip for transferring the one or more images from the image transfer belt to the media web, wherein the BTR and one or more media support rolls are configured to provide substantially zero wrap of the media web on the BTR during an engagement of the media web with the image transfer belt, and wherein the media web is label stock.

6. A continuous feed image marking apparatus comprising:

an image transfer belt including one or more developed images for transfer to a media web at an image transfer zone including a nip, the image transfer belt driven by a Drive Roll and an Assist Roll; the Drive Roll and Assist Roll driving an inside surface of the image transfer belt;

a Bias Transfer Roll (BTR) and one or more media web support rolls operatively associated with transferring the one or more developed images from the image transfer belt to the media web at the image transfer zone, the BTR and one or more media web support rolls configured to provide a selectably engageable/disengageable nip for transferring the one or more images from the image transfer belt to the media web, the BTR and one or more media support rolls selectably camminq an inside surface of the media web to engage/disengage the nip for transferring the one or more images from the image transfer belt to the media web, and a controller operatively connected to the Drive Roll, the Assist Roll and the BTR, the controller configured to disengage the BTR from the image transfer zone and engage the BTR for transfer of an image from the image transfer belt to the media web, wherein the BTR and one or more media support rolls are configured to provide substantially zero wrap of the media web on the BTR during an engagement of the media web with the image transfer belt, and wherein the controller is configured to perform a pilgrim step.

7. An electrostatographic printing apparatus, comprising:

a charge receptor including an endless belt;

a transfer nip including a BTR roll;

a continuous media supplied to a transfer zone including the BTR roll, the BTR adapted for systematic engagement and disengagement with an inside surface of the continuous media for synchronization of image transfer from the charge receptor to the continuous media provided to the transfer zone; and a vacuum roll drive adapted to reverse the direction of the continuous media through the transfer zone and resume the original direction in order to synchronize the transfer of images, whereby the vacuum roll drive creates drive on a non-image side of the continuous media, wherein the BTR is configured to provide substantially zero wrap of the continuous media on the BTR during the image transfer.

8. The printing apparatus of claim 7, wherein the vacuum roll drive controls a movement of the continuous media to a fuser device.

9. The printing apparatus of claim 7, wherein the transfer zone includes an Assist Roll and the BTR engaging the charge receptor to form a nip.

10. The printing apparatus of claim 9, wherein the BTR moves into and away from the Assist Roll to engage and disengage the nip.

11. The printing apparatus of claim 7, wherein a tension load roll maintains suitable pressure on the continuous media to adapt to direction changes.

12. An electrostatographic printing apparatus, comprising:

a charge receptor including an endless belt;

a transfer nip including a BTR roll; and a continuous media supplied to a transfer zone including the BTR roll, the BTR adapted for systematic engagement and disengagement with an inside surface of the continuous media for synchronization of image transfer from the charge receptor to the continuous media provided to the transfer zone, wherein the BTR is configured to provide substantially zero wrap of the continuous media on the BTR during the image transfer, and wherein the synchronization of the transfer of images is in relation to a seam associated with the charge receptor.

13. The printing apparatus of claim 12, wherein the transfer zone includes an Assist Roll and the BTR engaging the charge receptor to form a nip.

14. The printing apparatus of claim 12, wherein a tension load roll maintains suitable pressure on the continuous media to adapt to direction changes.

15. An electrostatographic printing apparatus, comprising:

a charge receptor including an endless belt;

a transfer nip including a BTR roll; and a continuous media supplied to a transfer zone including the BTR roll, the BTR adapted for systematic engagement and disengagement with an inside surface of the continuous media for synchronization of image transfer from the charge receptor to the continuous media provided to the transfer zone, wherein the BTR is configured to provide substantially zero wrap of the continuous media on the BTR during the image transfer, and wherein the synchronization of the transfer of images is in relation to printing of labels.

16. The printing apparatus of claim 15, wherein the transfer zone includes an Assist Roll and the BTR engaging the charge receptor to form a nip.

17. An electrostatographic printing apparatus, comprising:

a charge receptor including an endless belt;

a transfer nip including a BTR roll; and a continuous media supplied to a transfer zone including the BTR roll, the BTR adapted for systematic engagement and disengagement with an inside surface of the continuous media for synchronization of image transfer from the charge receptor to the continuous media provided to the transfer zone, wherein the BTR is configured to provide substantially zero wrap of the continuous media on the BTR during the image transfer, and wherein the BTR roll is a soft foam roll producing a nip of 3-5 mm width for generating a transfer field and depositing a positive tacking charge to the backside of the continuous media.

18. A method of operating an electrostatographic printing apparatus including a charge receptor; a transfer nip in contact with the charge receptor at a transfer zone, the transfer nip including an Assist Roll and a BTR Roll, and a source of continuous media provided to the transfer zone, wherein the BTR is configured to selectively cam an inside surface of the continuous media and provide substantially zero wrap of the continuous media on the BTR, the method of operating the printing apparatus including the systematic engagement and disengagement of the continuous media in the transfer nip for synchronization of image transfer from the charge receptor to the continuous media, the method comprising the steps of:

recognizing a requirement for the transfer nip to disengage from the continuous media, disengaging the continuous media from the nip, reengaging the media with the nip, and including the steps of altering the movement of the continuous media from a first direction to a reverse direction in response to the requirement and returning the movement of the continuous media to the first direction whereby the transfer of image from the charge receptor to the continuous media are in synchronization.

19. A method of operating an electrostatographic printing apparatus including a charge receptor; a transfer nip in contact with the charge receptor at a transfer zone, the transfer nip including an Assist Roll and a BTR Roll, and a source of continuous media provided to the transfer zone, wherein the BTR is configured to selectively cam an inside surface of the continuous media and provide substantially zero wrap of the continuous media on the BTR, the method of operating the printing apparatus including the systematic engagement and disengagement of the continuous media in the transfer nip for synchronization of image transfer from the charge receptor to the continuous media, the method comprising the steps of:

recognizing a requirement for the transfer nip to disengage from the continuous media, disengaging the continuous media from the nip, and reengaging the media with the nip, wherein the requirement is the recognition of a charge receptor seam.

20. The method of claim 19 including the steps of disengaging the BTR from the charge receptor during passage of the seam and reengaging the BTR after passage of the seam.

21. A method of operating an electrostatographic printing apparatus including a charge receptor; a transfer nip in contact with the charge receptor at a transfer zone, the transfer nip including an Assist Roll and a BTR Roll, and a source of continuous media provided to the transfer zone, wherein the BTR is configured to selectively cam an inside surface of the continuous media and provide substantially zero wrap of the continuous media on the BTR, the method of operating the printing apparatus including the systematic engagement and disengagement of the continuous media in the transfer nip for synchronization of image transfer from the charge receptor to the continuous media, the method comprising the steps of:

recognizing a requirement for the transfer nip to disengage from the continuous media, disengaging the continuous media from the nip, and reengaging the media with the nip, wherein the BTR roll is a soft foam roll producing a nip of 3-5 mm width for generating a transfer field and depositing a positive tacking charge to the backside of the paper.

* * * * *